US005986567A

United States Patent [19]

Shima

[11] Patent Number: 5,986,567

[45] **Date of Patent: *Nov. 16, 1999**

[54] SELECTIVELY CALLED WIRELESS RECEIVER WITH AUTOMATICALLY SELECTABLE OUTPUT

[75] Inventor: Makoto Shima, Shizuoka, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/712,834

[22] Filed: Sep. 12, 1996

[30] Foreign Application Priority Data

Sep. 13, 1995 [JP] Japan ..... 7-234967

[51] Int. Cl.[6] ..... G08B 5/22

[52] U.S. Cl. ..... 340/825.44; 455/38.1

[58] Field of Search ..... 340/825.44, 311.1, 340/384.1; 455/226.2, 38.1, 412, 67.1, 67.7; 381/57, 107; 348/738

[56] References Cited

U.S. PATENT DOCUMENTS 4,754,275 6/1988 Abbaticchio et al. ..... 340/825.44
5,258,751 11/1993 Deluca ..... 340/825.44
5,493,280 2/1996 Shibayama ..... 340/825.44
5,646,589 7/1997 Murray et al. ..... 340/384.1

FOREIGN PATENT DOCUMENTS 1-93222 4/1989 Japan .
5-235830 10/1993 Japan .

*Primary Examiner*—Brian Zimmerman
*Assistant Examiner*—Jean B. Jeanglaude
*Attorney, Agent, or Firm*—Sughrue, Mion, Zinn, Macpeak & Seas, PLLC

[57] ABSTRACT

A selectively called wireless receiver extracts a reception message signal destined to an intrastation from an electromagnetic wave wireless signal. When the peripheral area of the selectively called wireless receiver is quiet and dark, a message is outputted by voice. When the peripheral area of the selectively called wireless receiver is noisy and light, a message is outputted by display. When the peripheral area of the selectively called wireless receiver is quiet and light, a message is outputted by both of voice and display. When the peripheral area of the selectively called wireless receiver is nosy and dark, the reception message signal is temporarily stored in a memory and then a message is outputted after the peripheral area is changed to a good environment condition.

14 Claims, 4 Drawing Sheets

SELECTIVELY CALLED WIRELESS RECEIVER WITH AUTOMATICALLY SELECTABLE OUTPUT

BACKGROUND OF THE INVENTION

1. Field of the Invention

The present invention relates to a selectively called wireless receiver, and more particularly to technique which automatically and selectively outputs a received message to a display device and/or a speaker.

2. Description of Related Art

An example of this type of selectively called wireless receiver is conventionally disclosed in Japanese Laid Open Patent Disclosure (Heisei 1-93222). The selectively called wireless receiver includes a message display section and a message voice synthesizing section to inform a message to a user, and a switch. The message voice synthesizing section converts a message contained in a received wireless selective call signal or a fixed form message corresponding to the wireless selective call signal into the voice signal and synthesizes the voice signal to produce a voice message. The switch is a manual switch and is used to select the output form (display or voice) of the message. According to the selectively called wireless receiver, the message can be outputted by the display or by the voice by operating the switch.

By the way, the user of the above selectively called wireless receiver can switch the output form of the message depending upon the peripheral environment condition, e.g., peripheral noise and peripheral lightness. Because it is difficult to hear the voice from the receiver in a place where there is noise and loud conversation, for example, the user operates the switch to allow the received message to be displayed on the display device. Also, because it is difficult to see the display screen of the display device in a dark place, the user operates the switch to allow the received message to be outputted in voice. In this manner, because the switch must be manually operated in accordance with the peripheral environment condition in the conventional selectively called wireless receiver, there is a problem that the manual switching operation is complicated.

Further, there is another problem in that it is difficult for the user to recognize the received message under inferior environment condition, e.g., in a noisy and dark place.

SUMMARY OF THE INVENTION

Therefore an object of the present invention is to provide a method and selectively called wireless receiver in which a received message is outputted in the optimal output form automatically selected in accordance with a peripheral environment condition.

In order to achieve an aspect of the present invention, a selectively called wireless receiver includes a receiving section for extracting a reception message signal destined to an intrastation from a received electromagnetic wave wireless signal, a voice output section for outputting a message by voice based on an input signal, a display output section for displaying the message on a display device based on the input signal, a switch for selectively supplying the reception message signal from the receiving section to at least one of the voice output section and the display output section, a detecting section for detecting a peripheral environment condition around the selectively called wireless receiver, and a control section for controlling the switch based on the detecting result of the detecting section.

The voice output section is composed of a signal—voice converting and synthesizing circuit for converting an input signal into a voice signal and synthesizing the voice signal into a voice message, and a speaker. The display output section is composed of a display device and a display device driving circuit.

The detecting section may include a sound pressure detecting circuit for detecting a sound pressure around the selectively called wireless receiver. In this case, the control section controls the switch such that the reception message signal from the receiving section is supplied to the display output section when $SL \geqq A$ on the reception, and such that the reception message signal from the receiving section is supplied to the voice output section when $SL < A$ on the reception, where SL is a sound pressure detected by the sound pressure detecting circuit and A is a predetermined reference value. According to the above structure, the message is displayed on the display device of the display output section (which is referred to as a "display message" hereinafter) when the peripheral area is noisy. On the other hand, the message is outputted by voice from the speaker of the voice output section (which is referred to as a "voice message" hereinafter) when the peripheral area is quiet. Therefore, the user can recognize the message regardless of the peripheral noise.

The detecting section may include a light detecting circuit for detecting a lightness around the selectively called wireless receiver. In this case, the control section controls the switch such that the reception message signal from the receiving section is supplied to the display output section when $BL \geqq B$ on the reception, and such that the reception message signal from the receiving section is supplied to the voice output section when $BL < A$ on the reception, where BL is a lightness detected by the light detecting circuit and B is a predetermined reference value. According to the above structure, the display message is outputted when the peripheral area is light. On the other hand, the voice message is outputted when the peripheral area is dark. Therefore, the user can recognize the message regardless of the peripheral lightness.

The detecting section may include a sound pressure detecting circuit for detecting a sound pressure around the selectively called wireless receiver and a light detecting circuit for detecting a lightness around the selectively called wireless receiver. In this case, the control section controls the switch such that the reception message signal from the receiving section is supplied to the display output section when $SL \geqq A$ and $BL \geqq B$ on the reception, such that the reception message signal from the receiving section is supplied to the voice output section when $SL < A$ and $BL < B$ on the reception, and such that the reception message signal from the receiving section is supplied to at least one of the voice output section and the display output section when $SL < A$ and $BL \geqq B$ on the reception, where SL is a sound pressure detected by the sound pressure detecting circuit, BL is a lightness detected by the light detecting circuit, and A and B are predetermined reference values. According to the above structure, the display message is outputted when the peripheral area is noisy and light. The voice message is outputted when the peripheral area is quiet and dark. The voice message and/or display message is outputted when the peripheral area is quiet and light. Therefore, the user can recognize the message regardless of the peripheral noise and lightness.

The selectively called wireless receiver may further a memory section for storing the reception massage signal from the receiving section, and the detecting section may include a sound pressure detecting circuit for detecting a sound pressure around the selectively called wireless receiver and a light detecting circuit for detecting a lightness around the selectively called wireless receiver. In this case, the control section stores the reception message signal in the memory section when SL≧A and BL<B on the reception, and control the switch such that the reception message signal stored in the memory section is supplied to the display output section when a relation of SL≧A and BL≧B is established, such that the reception message signal stored in the memory section is supplied to the voice output section when a relation of SL<A and BL<B is established, and such that the reception message signal stored in the memory section is supplied to at least one of the voice output section and the display output section when a relation of SL<A and BL≧B is established, where SL is a sound pressure detected by the sound pressure detecting circuit, BL is a lightness detected by the light detecting circuit, and A and B are predetermined reference values. According to the above structure, the message is stored in the memory section when the peripheral area is noisy and dark, i.e., in a situation in which the message cannot be informed to the user. When the peripheral environment condition is changed, the message stored in the memory section is outputted. Therefore, the user can reliably receive the message under the desired environment condition.

DESCRIPTION OF THE PREFERRED EMBODIMENTS

Next, the selectively called wireless receiver of the present invention will be described with reference to the accompanying drawing.

Figure 1:
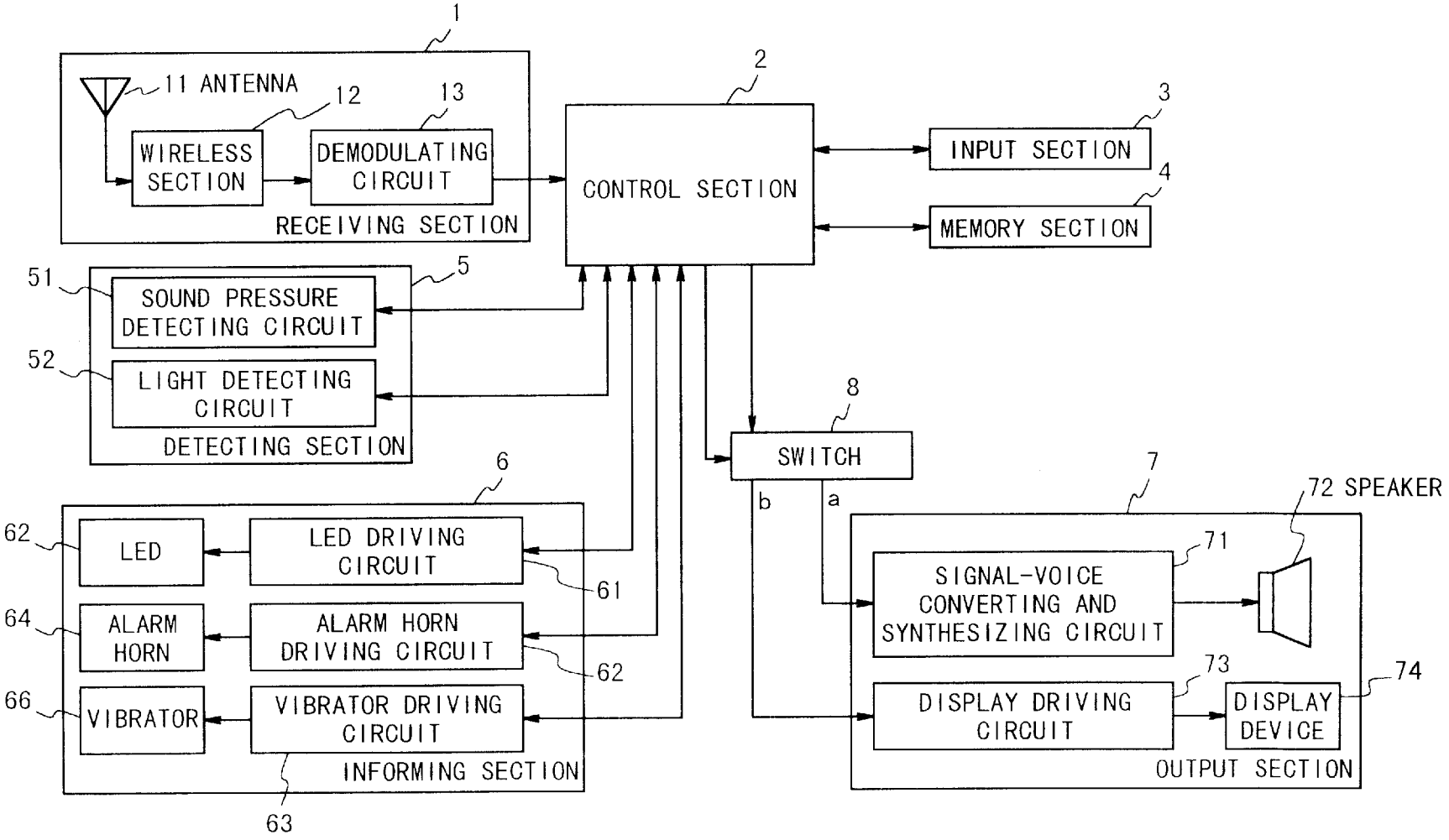
FIG. 1 is a block diagram illustrating the structure of a selectively called wireless receiver according to a first and second embodiment of the present invention.

FIG. 1 is a block diagram illustrating the structure of the selectively called wireless receiver according to the first and second embodiments of the present invention. Referring to FIG. 1, the selectively called wireless receiver according to the embodiments of the present invention is composed of a receiving section 1, a control section 2, an input section 3, a memory section 4, a detecting section 5, an informing section 6, a message outputting section 7 and a switch 8. The control section 2 is connected to the receiving section 1, the input section 3, the memory section 4, the detecting section 5, the informing section 6 and the switch 8. For example, the control section 2 can be composed in a CPU which operates in accordance with a control program.

The receiving section 1 is composed of an antenna 11, a wireless section 12 and a demodulating circuit 13. The antenna 11 receives electromagnetic wave wireless signal and supplies the wireless signal to the wireless section 12 as the wireless band signal. The wireless section 12 extracts a signal component from the received wireless band signal and supplies the extracted signal component to the demodulating circuit 13. The demodulating circuit 13 demodulates the received signal component. Thereby, the wireless selective call signal is obtained. The wireless selective call signal is supplied to the control section 2. The wireless selective call signal corresponds to a reception message signal of the present invention and contains the message destined the intrastation.

For example, the input section 3 can be composed of a keyboard. The input section 3 is used for the user to select the output form of a message from among the following ①–③. That is, the selectively called wireless receiver has three output forms of the messages: ① the message is outputted by voice, ② the message is displayed on the display device, and ③ the message is outputted by voice and displayed on the display device. When the output form of the message is specified by the input section 3, the detection result of the detecting section 5 is not used.

For example, the memory section 4 can be composed of a non-volatile erasable and programmable memory. The memory section 4 temporarily stores the wireless selective call signal from the receiving section 1 when the condition to be described later is accomplished. Also, the memory section 4 stores more than one fixed form message. The fixed form messages are read out from the memory section 4 by the control section 2, if necessary.

The detecting section 5 is composed of a sound pressure detecting circuit 51 and a light detecting circuit 52 in the first and the second embodiments. The sound pressure detecting circuit 51 detects a sound pressure level of peripheral noise. For example, the sound pressure detecting circuit 51 can be composed of a microphone and an A/D converter which converts an analog signal from the microphone into a digital signal. Also, the light detecting circuit 52 detects peripheral lightness. For example, the light detecting circuit 52 can be composed of a photo transistor and an A/D converter which converts an analog signal from the photo transistor into a digital signal. The output signals from these sound pressure detecting circuits 51 and light detecting circuit 52 are supplied to the control section 2.

The informing section 6 is used to inform to the user that a wireless signal destined to the intrastation is received. The informing section 6 has three kinds of informing means. The first informing means is composed of an LED drive circuit 61 and an LED 62, the second informing means is composed of an alarm horn drive circuit 63 and an alarm horn 64, and the third informing means is composed of a vibrator drive circuit 65 and a vibrator 66. Note that the informing section 6 may be composed of any one or two of the three kinds of informing means.

The message outputting section 7 outputs the received message or the message read out from the memory section 4. This message outputting section 7 is composed of a voice outputting means and a display outputting means. The voice outputting means can be composed of a signal—voice converting and synthesizing circuit 71 and a speaker 72. The signal—voice converting and synthesizing circuit 71 converts the received message signal from the receiving section 1 or the message signal read out from the memory section 4 into the voice signal. The voice signal outputted from the signal—voice converting and synthesizing circuit 71 is supplied to the speaker 72. Thereby, the message is outputted by voice from the speaker 72. Also, the display outputting means can be composed of a display drive circuit 73 and a display section 74. For example, as the display section 74, a liquid crystal display device (LCD) can be used. The control section 2 produces a display data based on the received message signal by the receiving section 1 or the message signal read out from the memory section 4. The display data is supplied to the display drive circuit 73. Thereby, the message is displayed on the display section 74 in letters, a figure, symbols and so.

The switch 8 is used to switch the output form of the message. The switching of the switch 8 is controlled by a switch control signal from the control section 2. The switch control signal is generated by the control section 2 based on a signal from the input section 3 and a signal from the detecting section 5. The received message signal from the control section 2 and the message signal read out from the memory section 4 are inputted to the switch 8. Then, the received message signal or the read out message signal is outputted to the voice side a or the display side b or both of the voice side and display side in accordance with the switch control signal.

Figure 2:
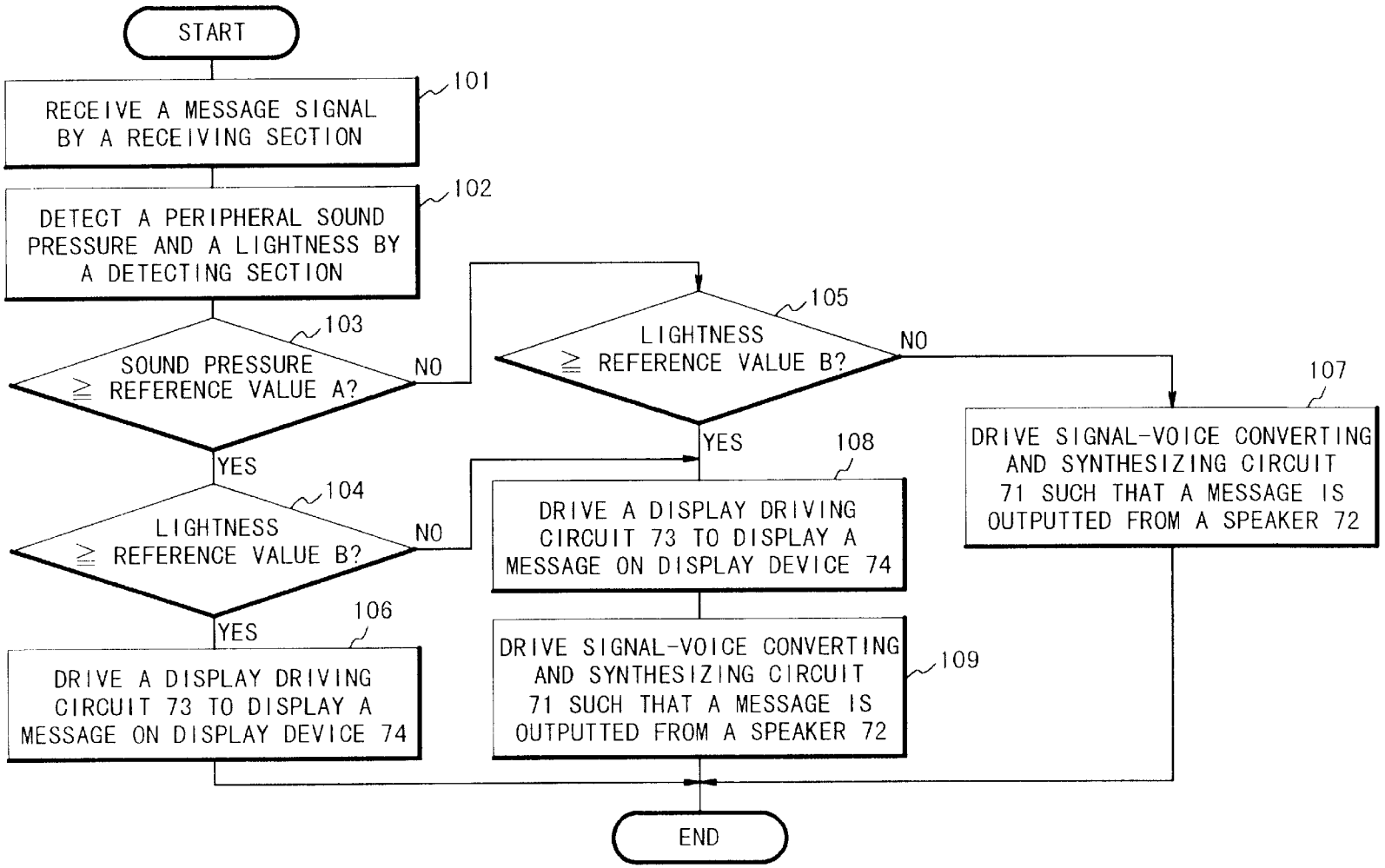
FIG. 2 is a flow chart showing the processing of the first embodiment when a message destined to the intrastation is received.

Next, the operation of the first embodiment will be described. FIG. 2 is the flow chart showing the processing when the message destined to the intrastation is received. When receiving an electromagnetic wave wireless signal, the receiving section 1 first extracts a wireless selective call signal which contains a message destined to the intrastation. The wireless selective call signal is sent to the control section 2 as the received message signal (step 101). Also, when the message destined to the intrastation is received, the sound pressure detecting circuit 51 of the detecting section 5 detects the peripheral sound pressure or noise level. The data indicative of the detected peripheral sound pressure is sent to the control section 2. Similarly, the light detecting circuit 52 detects peripheral lightness. The data indicative of the detected peripheral lightness is also sent to the control section 2 (step 102).

The control section 2 controls the switch 8 in accordance with the data indicative of the peripheral sound pressure and the data indicative of the peripheral lightness sent from the detecting section 5 (step 103–105). That is, the control section 2 generates a switch control signal such that the signal supplied to the switch 8 is outputted from the voice side a when the data indicative of the peripheral sound pressure from the sound pressure detecting circuit 51 is smaller than a reference value A and such that the signal supplied to the switch 8 is outputted from the display side b when the data indicative of the peripheral sound pressure is equal to or larger than the reference value A. On the other hand, the control section 2 generates the switch control signal such that the signal supplied to the switch 8 is outputted from the voice side a when the data indicative of the peripheral lightness from the light detecting circuit 52 is smaller than a reference value B and such that the signal supplied to the switch 8 is outputted from the display side b when the data indicative of the peripheral lightness is equal to or larger than the reference value B. The generated switch control signal is supplied to the switch 8. Therefore, when the peripheral area of the selectively called wireless receiver is quiet and dark, the switch 8 outputs the received message signal to the voice side a. Also, when the peripheral area is noisily but light, the switch 8 outputs the received message signal to the display side b. Further, when the peripheral area is quiet and light or when the peripheral area is noisy and dark, the switch 8 outputs the received message signal to both of the voice side a and the display side b.

The output means 7 converts the signal outputted to the voice side a of the switch 8 into a voice signal by the signal—voice converting and synthesizing circuit 71 and supplies the voice signal to the speaker 72. In this manner, the message is outputted from the speaker 72 by voice (step 107, 109). Also, the output means 7 supplies the signal outputted to the display side b of the switch 8 to the display drive circuit 73. In this manner, the display drive circuit 73 drives the display section 74 in response to the signal to display the message on the display section 74 (step 106, 108).

As described above, when the peripheral area of the selectively called wireless receiver is quiet and dark, the voice message is outputted. Also, when the peripheral area is noisily but light, the display message is outputted. Further, when the peripheral area is quiet and light or when the peripheral area is noisy and dark, both of the voice message and the display message are outputted.

Next, the second embodiment of the present invention will be described. The second embodiment is different from the above-mentioned first embodiment in the operation of the selectively called wireless receiver when the data indicative of the peripheral sound pressure is equal to or larger than the reference value A and when the data indicative of the peripheral lightness is smaller than the reference value B, in other words, when the peripheral area is noisy and dark.

Figure 3:
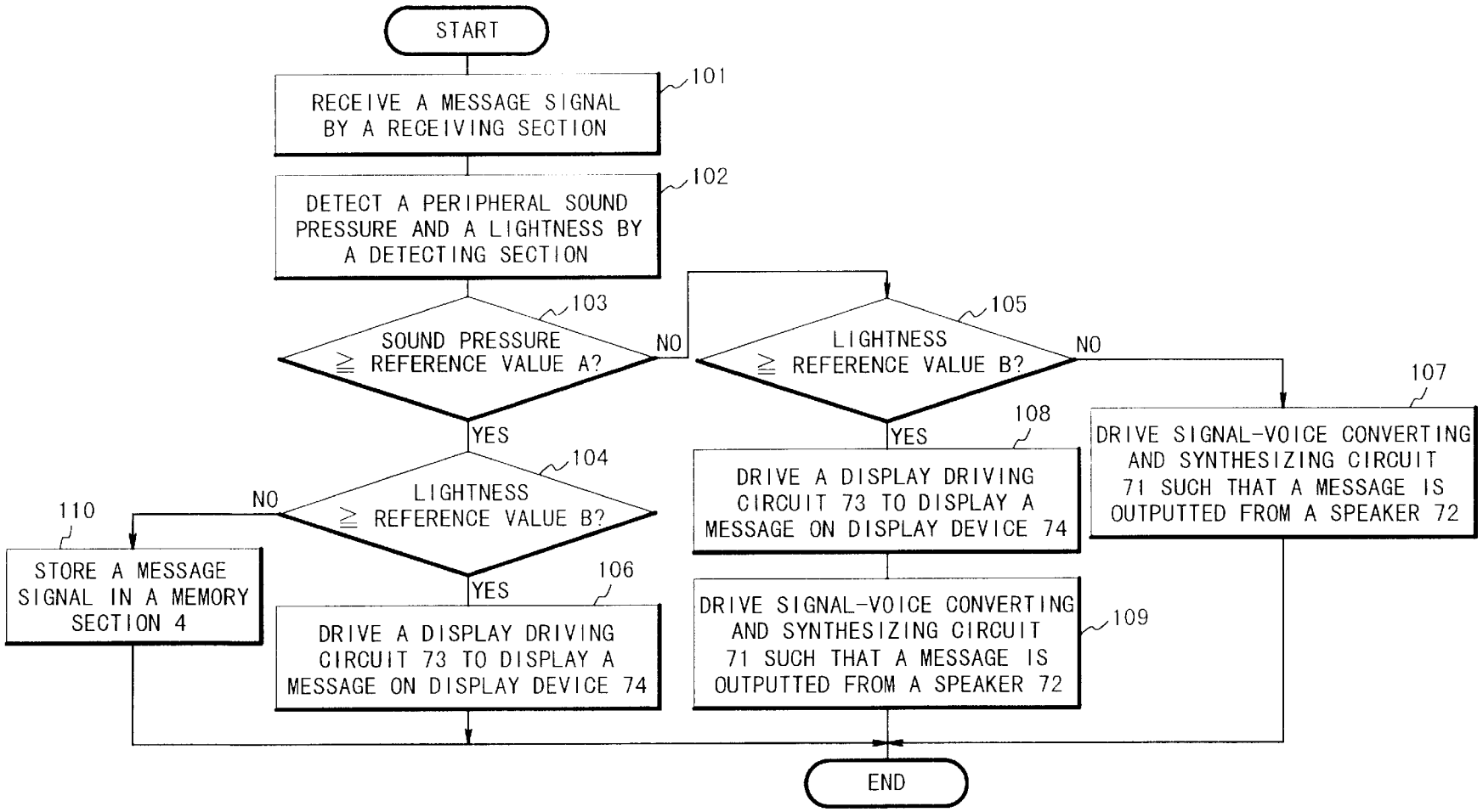
FIG. 3 is a flow chart showing the processing of the second embodiment when a message destined to the intrastation.

The operation of the second embodiment will be described with reference to FIGS. 3 and 4. FIG. 3 is the flow chart showing the processing when a message destined to the intrastation is received. The flow chart shown in FIG. 3 is different from the flow chart shown in FIG. 2 in the processing when the answer of the step 104 in FIG. 2 is "NO".

That is, the control section 2 generates the switch control signal such that the signal supplied to the switch 8 is outputted from neither the voice side a nor the display side b when the data indicative of the peripheral sound pressure from the sound pressure detecting circuit 51 is equal to or larger than the reference value A and when the data indicative of the peripheral lightness from the light detecting circuit 52 is smaller than the reference value B. The control section 2 stores the received message signal in the memory section 4 (step 110). Therefore, when the peripheral area of the selectively called wireless receiver is noisy and dark, both the voice message output and the display message output based on the received message signal are prevented and the received message signal is stored in the memory section 4.

Figure 4:
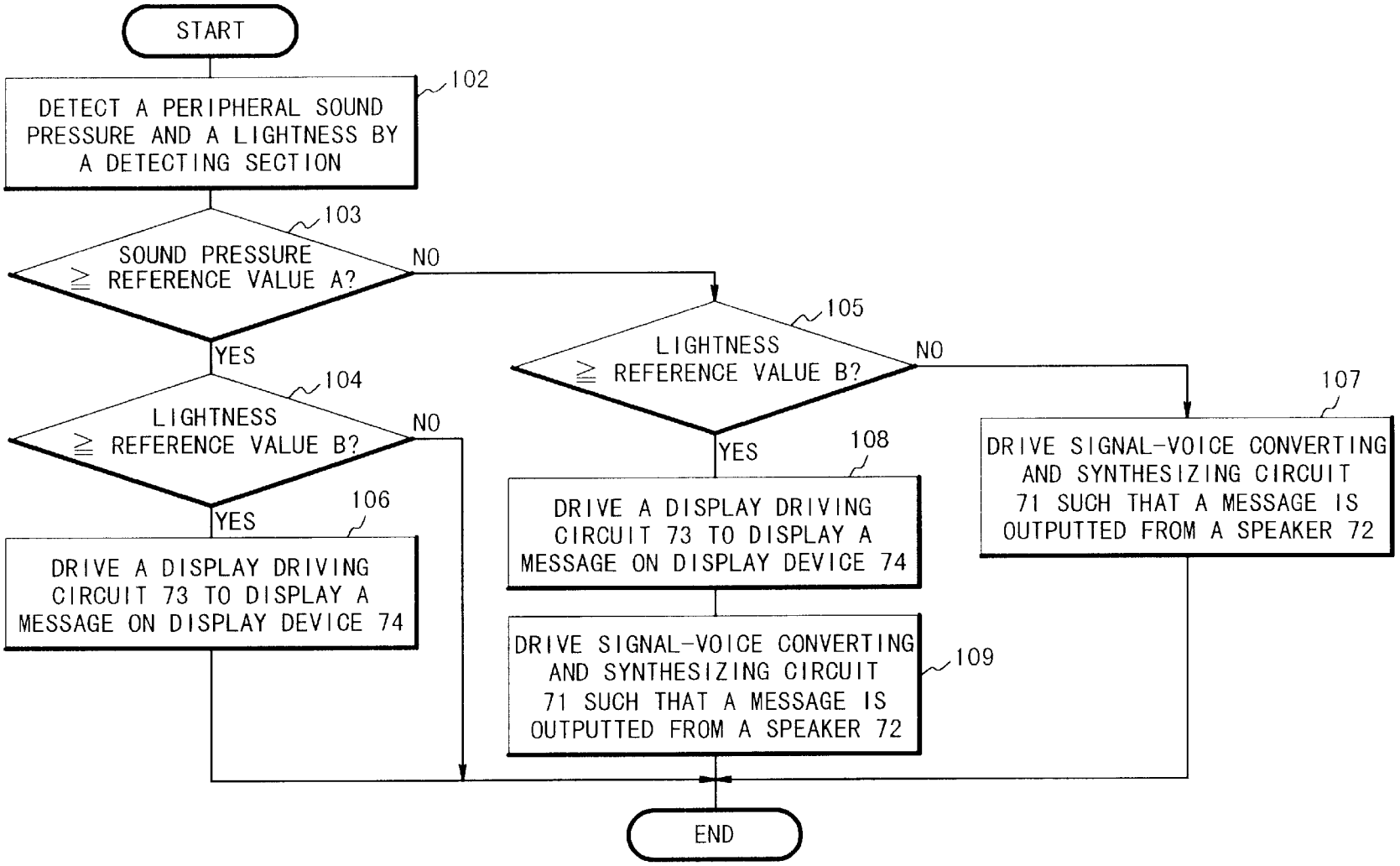
FIG. 4 is a flow chart showing the processing which is executed every predetermined time period after the message destined to the intrastation is received in the second embodiment.

Thereafter, the selectively called wireless receiver executes the process shown in FIG. 4 for every predetermined time period. That is, the every predetermined time period, the sound pressure detecting circuit 51 of the detecting section 5 detects the peripheral sound pressure and the light detecting circuit 52 detects the peripheral lightness. The data indicative of the detected peripheral sound pressure and the data indicative of the peripheral lightness are sent to the control section 2 (step 102).

The control section 2 controls the switch 8 in accordance with the signals indicative of the detecting results sent from the detecting section 5 (step 103–105). The processing of the control section 2 is the same as the processing of the above-mentioned first embodiment other than the processing when the answer of the step 104 is "NO". In the second embodiment, when the answer of the step 104 is "NO", the peripheral environment condition is recognized not to be changed, resulting in ending the processing. Therefore, the switch 8 is held in the previous state.

With the processing of FIG. 3 and FIG. 4 mentioned above, when the peripheral area of the selectively called wireless receiver is noisy and dark, any message output is performed and the wireless receiver is in a waiting state until the peripheral environment condition changes. Whether the peripheral environment condition changes is checked for every predetermined time period. When it is determined that the peripheral environment condition is changed, the message is outputted in the same manner as in the case of the above-mentioned first embodiment.

That is, when the peripheral environment condition is changed from the noisy and dark condition to a quiet and dark condition, the switch 8 outputs the message signal from the memory section 4 to the voice side a. Also, when the peripheral environment condition is changed to a noisy and light condition, the switch 8 outputs the message signal from the memory section 4 to the display side b. Further, when the peripheral environment condition is changed to a quiet and light condition, the switch 8 outputs the message signal from the memory section 4 to both of the voice side a and the display side b. Note that when the peripheral environment condition does not change, the switch 8 holds the previous state.

According to the second embodiment, by selecting suitable values as the reference values A and B, when the data indicative of the peripheral sound pressure is extremely large and the data indicative of the peripheral lightness is very small, i.e., in the situation in which the message can not be informed by voice or display, the received message signal is temporarily stored in the memory section 4. Then, when the peripheral environment condition is recovered to the normal state, the message is outputted by the voice message and/or the display message.

In the first and second embodiments described above, when the peripheral environment condition is quiet and light, the message is outputted by both of the display message and the voice message. However, the massage may be outputted by either one of the voice massage and the display message. This can be realized removing either of the step 108 and the step 109 in FIGS. 2, 3 and 4.

Also, it is possible to construct the selective called wireless receiver such that the output form can be switched manually in accordance with an instruction from the keyboard of the input section 3. In this case, a manual switching signal is supplied to the control section 2 from the keyboard of the input section 3. The control section 2 controls the switch 8 based on the manual switching signal. Thus, the message can be outputted in either of the above-mentioned ①–③ output forms.

Further, the detecting section 5 mentioned above in the first and second embodiments includes both of the sound pressure detecting circuit 51 and the light detecting circuit 52. However, the detecting section 5 may compose of only either one of the detecting circuits 51 and 52.

As described above, the selectively called wireless receiver of the present invention outputs the received message in the optimal output form which is automatically selected in accordance with the peripheral environment condition. Therefore, the user is not required the troublesome operation and the message can be received with the optimal method.

Also, when the peripheral environment condition is inferior, i.e., noisy and dark, so that it is difficult to receive the message, the received message is temporarily stored in the memory and when the peripheral environment condition is improved, the stored message is outputted. Therefore, the message can be reliably received.

What is claimed is:

1. A selectively called wireless receiver comprising:

a receiving section for extracting a reception message signal destined to an intrastation from a received electromagnetic wave wireless signal;

output means for outputting a message corresponding to the reception message signal; a memory section for storing the reception message signal from said receiving section;

a detecting section for detecting a peripheral environment condition around said selectively called wireless receiver;

an input section for manually specifying an output Form of the message to be outputted to said output means; and a control section for supplying the reception message signal to said output means when said output form of the message is not specified by said input section and the detecting result of said detecting section indicates that peripheral environment condition is suitable for the output of the message, and for controlling the memory section to store the reception message signal when said output form of the message is not specified said input section and the detecting result of said detecting section indicates that the peripheral environment condition is not suitable for the output of the message, and then for automatically supplying the stored reception message signal to said output means, when said output form of the message is not specified by said input section and the detecting result of said detecting section indicates, after the storage, that the peripheral environment condition is suitable for the output of the message.

2. A selectively called wireless receiver according to claim 1, wherein said detecting section includes a sound pressure detecting circuit for detecting a sound pressure around said selectively called wireless receiver, and wherein said output means includes voice output means for outputting a message corresponding to the reception message signal by voice, and wherein said control section supplies the reception message signal from said receiving section to said voice output means when said output form of the message is not specified by said input section and $SL<A$ is detected by said sound pressure detecting circuit on the reception, and stores the reception message signal from said receiving section in said memory section when said output form of the message is not specified by said input section and $SL \geqq A$ is detected by said sound pressure detecting circuit on the reception, where SL is a sound pressure detected by said sound pressure detecting circuit and A is a predetermined reference value.

3. A selectively called wireless receiver according to claim 2, wherein said control section automatically supplies the reception message signal stored in said memory section to said voice output means when said output form of the message is not specified by said input section and the sound pressure detected by said sound pressure detecting circuit is changed into $SL<A$ from $SL \geqq A$.

4. A selectively called wireless receiver according to claim 1, wherein said detecting section includes a light detecting circuit for detecting a peripheral lightness around said selectively called wireless receiver, and wherein said output means includes display output means for outputting a message corresponding to the reception message signal by display, and wherein said control section supplies the reception message signal from said receiving section to said display output means when said output form of the message is not specified by said input section and BL≧B is detected by said light detecting circuit on the reception, and stores the reception message signal from said receiving section in said memory section when said output form of the message is not specified by said input section and BL<B is detected by said light detecting circuit on the reception, where BL is the peripheral lightness detected by said light detecting circuit and B is a predetermined reference value.

5. A selectively called wireless receiver according to claim 4, wherein said control section automatically supplies the reception message signal stored in said memory section to said display output means when said output form of the message is not specified by said input section and the peripheral lightness detected by said light detecting circuit is changed into BL≧B from BL<B.

6. A selectively called wireless receiver according to claim 1 wherein said detecting section includes:

a sound pressure detecting circuit for detecting a sound pressure around said selectively called wireless receiver; and a light detecting circuit for detecting a lightness around said selectively called wireless receiver, and wherein said output means includes:

voice output means for outputting a message corresponding to the reception message signal by voice; and display output means for displaying a message corresponding to the reception message signal on a display device, and wherein said control section supplies the reception message signal from said receiving section to at least one of said voice output means and said display output means when said output form of the message is not specified by said input section and SL<A is detected by said sound pressure detecting circuit and BL≧B is detected by said light detecting circuit on the reception, and supplies the reception message signal from said receiving section to said voice output means when said output form of the message is not specified by said input section and SL<A is detected by said sound pressure detecting circuit and BL<B is detected by said light detecting circuit on the reception, and supplies the reception message signal from said receiving section to said display output means when said output form of the message is not specified by said input section and SL≧A is detected by said sound pressure circuit and BL≧B is detected by said light detecting circuit on the reception, and stores the reception message signal in said memory section when said output form of the message is not specified by said input section and SL≧A is detected by said sound pressure circuit and BL<B is detected by said light detecting circuit on the reception, where SL is a sound pressure detected by said sound pressure detecting circuit, BL is a lightness detected by said light detecting circuit, and A and B are predetermined reference values.

7. A selectively called wireless receiver according to claim 6, wherein said control section automatically supplies the reception message signal stored in said memory section to said voice output means when said output form of the message is not specified by said input section and the sound pressure detected by said sound pressure detecting circuit is changed into SL<A from SL≧A, and supplies the reception message signal stored in said memory section to said display output means when said output form of the message is not specified by said input section and the peripheral lightness detected by said light detecting circuit is changed into BL<B from BL<B, and supplies the reception message signal stored in said memory section to at least one of said voice output means and said display output means when said output form of the message is not specified by said input section and the sound pressure detected said sound pressure detecting circuit is changed into SL<A from SL≧A and the peripheral lightness detected by said light detecting circuit is changed into BL≧B from BL<B.

8. A method of informing a received message in an optimal output form in a selectively called wireless receiver, comprising the steps of:

extracting a reception message signal destined to an intrastation from a received electromagnetic wave wireless signal;

detecting a peripheral environment condition around said selectively called wireless receiver;

manually specifying an output form of the message to be outputted; and outputting a message corresponding to the reception message signal when said output form is not specified and the detecting result indicates that the peripheral environment condition is suitable for the output of the message, and storing the reception message signal in a memory section when said output form is not specified and the detecting result indicates that the peripheral environment condition is not suitable for the output of the message and then automatically outputting the stored reception message signal, when said output form is not specified and the detecting result indicates, after the storage, that the peripheral environment condition is suitable for the output of the message.

9. A method according to claim 8, wherein said detecting step includes detecting a peripheral noise level around said selectively called wireless receiver, and wherein said outputting step includes outputting a message corresponding to the reception message signal by voice when said output form is not specified and SL<A is detected on the reception, and storing the reception message signal in said memory section when said output form is not specified and SL≧A is detected on the reception, where SL is the detected peripheral noise level and A is a predetermined reference value.

10. A method according to claim 9, wherein said outputting step includes outputting the reception message signal stored in said memory section by voice when said output form is not specified and the detected peripheral noise level is changed into SL<A from SL≧A.

11. A method according to claim 8, wherein said detecting step includes detecting a peripheral lightness around said selectively called wireless receiver, and wherein said outputting step includes outputting a message corresponding to the reception message signal by display when said output form is not specified and BL≧B is detected on the reception, and storing the reception message signal in said memory section when said output form is not specified and BL<B is detected on the reception, where BL is the detected peripheral lightness and B is a predetermined reference value.

12. A method according to claim 11, wherein said outputting step includes outputting the reception message signal stored in said memory section by display when said output form is not specified and the detected peripheral lightness is changed into BL≧B from BL<B.

13. A method according to claim 8, wherein said detecting step includes detecting a peripheral noise level and a peripheral lightness around said selectively called wireless receiver, and wherein said outputting step includes outputting a message corresponding to the reception message signal by at least one of voice and display when said output form is not specified and SL<A and BL≧B is detected on the reception, and outputting a message corresponding to the reception message signal by voice when said output form is not specified and SL<A and BL<B is detected on the reception, and outputting a message corresponding to the reception message signal by display when said output form is not specified and SL≧A and BL≧B is detected on the reception, and storing the reception message signal in the memory section when said output form is not specified and SL≧A and BL<B is detected on the reception, where SL is the detected peripheral noise level, BL is the detected peripheral lightness detected, and A and B are predetermined reference values.

14. A method according to claim 13, wherein said outputting step includes outputting the reception message signal stored in said memory section by voice when said output form is not specified and the detected peripheral noise level is changed into SL<A from SL≧A, and outputting the reception message signal stored in said memory section by display when said output form is not specified and the detected peripheral lightness is changed into BL≧B from BL<B, and outputting the reception message signal by at least one of voice and display when said output form is not specified and the detected peripheral noise level is changed into SL<A from SL≧A and the detected peripheral lightness is changed into BL≧B from BL<B.

* * * * *

UNITED STATES PATENT AND TRADEMARK OFFICE

CERTIFICATE OF CORRECTION

PATENT NO. : 5,986,567
DATED : November 16, 1999
INVENTOR(S) : Makoto Shima

It is certified that error appears in the above-identified patent and that said Letters Patent is hereby corrected as shown below:

On the title page, add the following:

FOREIGN PATENT OR PUBLISHED FOREIGN PATENT APPLICATION

| | | DOCUMENT NUMBER | PUBLICATION DATE | COUNTRY OR PATENT OFFICE | CLASS | SUBCLASS | TRANSLATION YES | TRANSLATION NO |
|---|---|---|---|---|---|---|---|---|
| | | JP-A-59-104839 | 06/16/84 | JAPAN | | | | X |
| | | | | | | | | |

Signed and Sealed this

Twenty-ninth Day of August, 2000

*Attest:*

*Attesting Officer*

Q. TODD DICKINSON

*Director of Patents and Trademarks*